US009339117B1

(12) United States Patent
Limer et al.

(10) Patent No.: US 9,339,117 B1
(45) Date of Patent: May 17, 2016

(54) MATTRESS WITH A VISCO ELASTIC POLYURETHANE FOAM LAYER

(71) Applicant: Hickory Springs Manufacturing Company, Hickory, NC (US)

(72) Inventors: William B. Limer, Hickory, NC (US); Danny G. Maxwell, Hickory, NC (US)

(73) Assignee: HICKORY SPRINGS MANUFACTURING COMPANY, Hickory, NC (US)

( * ) Notice: Subject to any disclaimer, the term of this patent is extended or adjusted under 35 U.S.C. 154(b) by 0 days.

(21) Appl. No.: 14/279,722

(22) Filed: May 16, 2014

Related U.S. Application Data

(60) Provisional application No. 61/827,180, filed on May 24, 2013.

(51) Int. Cl.

| | |
|---|---|
| ***A47C 23/04*** | (2006.01) |
| ***A47C 27/14*** | (2006.01) |
| ***A47C 27/06*** | (2006.01) |
| ***A47C 27/15*** | (2006.01) |
| ***A47C 27/20*** | (2006.01) |

(52) U.S. Cl.
CPC ..... *A47C 27/148* (2013.01); *A47C 27/064* (2013.01); *A47C 27/15* (2013.01); *A47C 27/20* (2013.01)

(58) Field of Classification Search
CPC ..... A47C 27/148; A47C 27/20; A47C 27/15; A47C 27/064; A47C 27/04; A47C 27/0453; A47C 27/05; A47C 27/053; A47C 27/056; A47C 27/063
See application file for complete search history.

(56) References Cited

U.S. PATENT DOCUMENTS

| | | | | |
|---|---|---|---|---|
| 5,107,558 | A | 4/1992 | Luck | |
| 5,513,402 | A * | 5/1996 | Schwartz | 5/691 |
| 6,353,952 | B1 * | 3/2002 | Wells | 5/716 |
| 6,398,199 | B1 * | 6/2002 | Barber | 267/93 |
| 6,658,682 | B1 | 12/2003 | Wells | |
| 7,444,702 | B2 | 11/2008 | Fogg | |
| 7,469,437 | B2 | 12/2008 | Mikkelsen et al. | |
| 7,507,468 | B2 | 3/2009 | Landvik et al. | |
| 7,555,615 | B2 | 6/2009 | Landvik | |
| 7,707,670 | B2 | 5/2010 | Fogg | |
| 7,735,169 | B2 | 6/2010 | Wassilefsky | |
| 7,979,374 | B2 | 7/2011 | Landvik | |
| 8,025,964 | B2 | 9/2011 | Landvik et al. | |
| 8,034,445 | B2 | 10/2011 | Landvik et al. | |
| 8,296,976 | B2 * | 10/2012 | Murphy et al. | 40/320 |
| 8,418,297 | B2 | 4/2013 | Mikkelsen et al. | |
| 8,561,236 | B2 | 10/2013 | Witherell et al. | |
| 8,832,888 | B2 | 9/2014 | Chunglo | |
| 8,984,690 | B2 * | 3/2015 | Chunglo | 5/739 |
| 2006/0096032 | A1 * | 5/2006 | Rensink | 5/721 |
| 2007/0022540 | A1 | 2/2007 | Hochschild | |
| 2007/0283501 | A1 | 12/2007 | Mossbeck | |
| 2008/0115288 | A1 * | 5/2008 | Poulos | 5/727 |
| 2009/0031502 | A1 * | 2/2009 | Berrcocal et al. | 5/716 |

(Continued)

*Primary Examiner* — David E Sosnowski
(74) *Attorney, Agent, or Firm* — Perkins Coie LLP

(57) ABSTRACT

A foam mattress is provided having a body facing surface comprising a viscoelastic foam layer. The body facing surface further comprises a recess or cavity into which a layer including a core of springs may be provided. The foam mattress further having a layer of open cell foam beneath the viscoelastic foam layer. The open cell, or reticulated, foam layer provides increased breathability. Support for the mattress may further be provided by a bottom layer of conventional foam.

16 Claims, 5 Drawing Sheets

(56) References Cited

U.S. PATENT DOCUMENTS

| | | | | |
|---|---|---|---|---|
| 2010/0325806 | A1* | 12/2010 | Letton et al. | 5/691 |
| 2012/0180224 | A1* | 7/2012 | DeMoss et al. | 5/717 |
| 2012/0297546 | A1 | 11/2012 | Gladney | |
| 2013/0283538 | A1 | 10/2013 | Young et al. | |
| 2014/0165292 | A1 | 6/2014 | Gladney | |
| 2014/0283307 | A1* | 9/2014 | Corodemus | 5/691 |
| 2014/0304921 | A1* | 10/2014 | Collins et al. | 5/727 |
| 2014/0373280 | A1* | 12/2014 | Mossbeck et al. | 5/718 |

* cited by examiner

MATTRESS WITH A VISCO ELASTIC POLYURETHANE FOAM LAYER

CROSS-REFERENCE TO RELATED PATENT APPLICATIONS

This application claims priority to U.S. Provisional Application No. 61/827,180, filed May 24, 2013, the entirety of which is hereby incorporated by reference.

BACKGROUND

Beds and other support surfaces for the body have been in existence for centuries. From straw and fabric to the highly technical mattresses of today, the industry has sought to improve upon the support for a person at rest in a supine position. People spend, on average, close to ⅓ of their life span asleep. Therefore, the need for comfortable support for the body during the sleep period is highly desirable.

The technology relating to improving mattresses is diverse and includes many designs that are oriented towards individual comfort. Some designs include spring based technology, some designs include air based technology, and some designs include foam based technology.

With specific regard to foam based technology, many mattresses today are constructed either entirely or partially out of foam material. The foam material may include closed cell and/or open cell foams as are generally known in the art. The foam material may be formed from polyurethane foam, for example, or other conventional foams. The polyurethane foams may include conventional polyurethane foam, open cell or reticulated polyurethane foams, and viscoelastic polyurethane foams. Currently, the industry trends are focusing on types of viscoelastic polyurethane foams (sometimes generically referred to as "Memory Foam") to increase comfort and support for the individual resting on the bed.

A conventional mattress 100 formed using polyurethane foams is shown in FIG. 1. The mattress 100 conventional includes a top layer 102 and a bottom layer 104. The top layer 102 is generally designed for comfort and may include, for example, viscoelastic foam. The bottom layer 104 is generally for support and may include a closed or open cell structure polyurethane foam. In certain aspects, the mattress 100 may include a layer of breathable or open cell foam 106, such as, for example, foams generally referred to as reticulated polyurethane foams.

In some cases, a conventional foam mattress may be formed using a closed or open cell structure polyurethane foam similar to the above for support. Comfort for such a conventional mattress may be improved by adding a "topper" as is generally known in the art. A topper may be formed of viscoelastic polyurethane foam.

However, despite improvements in the types and combination of foams, a need exists in the industry for improved comfort and support for mattresses formed at least partially from foam. Thus, against this background, an improved mattress is desirable.

SUMMARY

This Summary is provided to introduce a selection of concepts in a simplified form that are further described below in the Detailed Description. This Summary, and the foregoing Background, is not intended to identify key aspects or essential aspects of the claimed subject matter. Moreover, this Summary is not intended for use as an aid in determining the scope of the claimed subject matter.

In one aspect, the technology of the present application provides a viscoelastic foam top layer. The viscoelastic foam may be of a closed or open cell structure. The viscoelastic foam may be gel infused and/or contain other elements including phase change materials, antimicrobials, or the like. The viscoelastic foam top layer may comprise a plurality of separate layers stacked or aligned to cooperate with each other and provide a recess or cavity on the body facing surface of the mattress. A layer of springs (used generically) may be fitted to the recess, such as, for example, a layer of individually pocketed spring coils. A bottom support layer of foam is provided. The bottom support layer may be of a closed or open cell structure. An intermediate layer of foam having an open cell structure may be provided. The open cell structure provides for increased breathability and may facilitate the transfer of body heat through the viscoelastic foam layer.

These and other aspects of the present system and method will be apparent after consideration of the Detailed Description and Figures herein.

DRAWINGS

Non-limiting and non-exhaustive embodiments of the present invention, including the preferred embodiment, are described with reference to the following figures, wherein like reference numerals refer to like parts throughout the various views unless otherwise specified.

DETAILED DESCRIPTION

The technology of the present application will now be described more fully below with reference to the accompanying figures, which form a part hereof and show, by way of illustration, specific exemplary embodiments. These embodiments are disclosed in sufficient detail to enable those skilled in the art to practice the technology of the present application. However, embodiments may be implemented in many different forms and should not be construed as being limited to the embodiments set forth herein. The following detailed description is, therefore, not to be taken in a limiting sense.

The technology of the present application is described with specific reference to a mattress construction to support a supine individual, adult, or child. However, the technology described herein may be used for other structures where comfort and support are desirous such as, for example, chairs, hammocks, vehicle seats, and the like. Moreover, the technology of the present application will be described with relation to exemplary embodiments. The word "exemplary" is used herein to mean "serving as an example, instance, or illustration." Any embodiment described herein as "exemplary" is not necessarily to be construed as preferred or advantageous over other embodiments. Additionally, unless specifically identified otherwise, all embodiments described herein should be considered exemplary.

Figure 1:
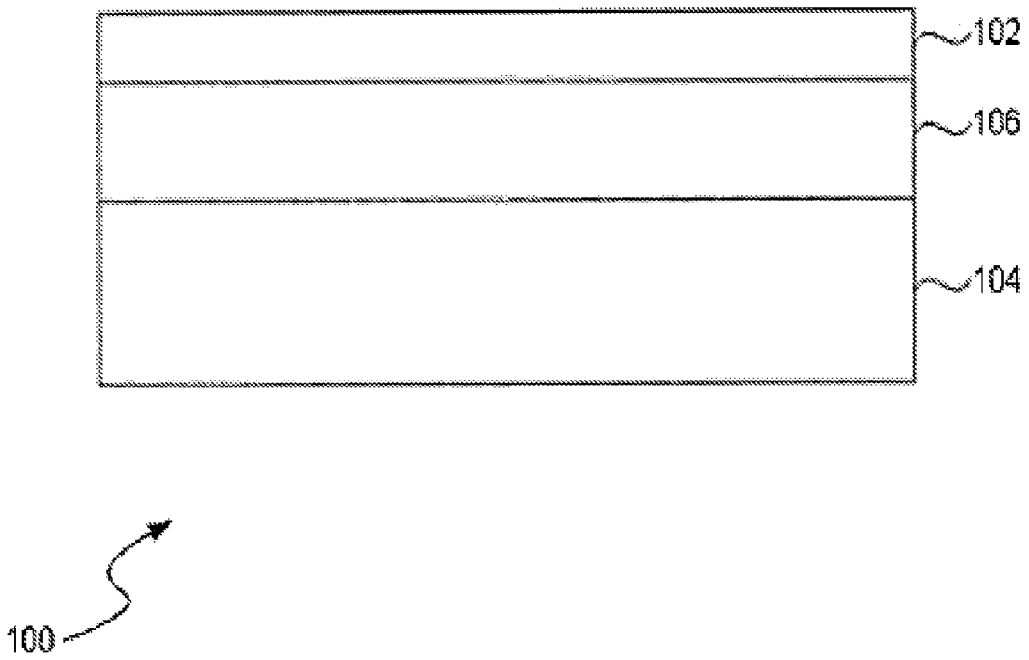
FIG. 1 PRIOR ART
FIG. 1 depicts a cross sectional view of a conventional mattress construction.
Figure 2:
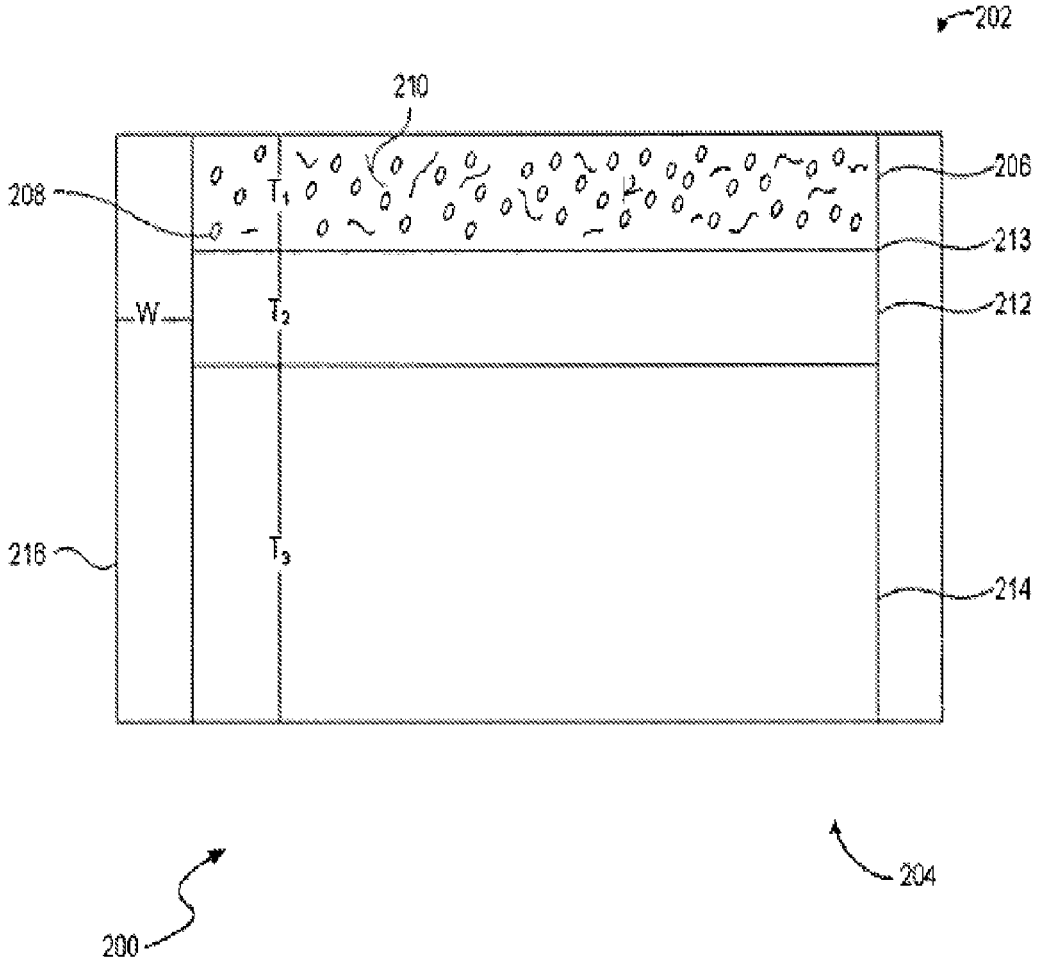
FIG. 2 depicts a cross sectional view of a mattress constructed in accordance with an aspect of the present technology.

With reference now to FIG. 2, a mattress 200 consistent with the technology of the present application is provided. The mattress 200 is shown in cross-section for ease of reference. The mattress 200 has a top side 202, which may be referred to as the body facing side, and a bottom side 204. The designations of top and bottom are provided for orientation and should not be considered limiting in and of themselves. From body facing or top side 202 to bottom side 204, the mattress 200 is provided with a first layer of foam ("first foam layer") 206, a second layer of foam ("second foam layer") 212, and a third layer of foam ("third foam layer") 214.

The first foam layer 206 comprises a viscoelastic polyurethane foam for comfort and support. While any conventional viscoelastic foams may be used, the first foam layer 206 may be either a closed cell or an open cell viscoelastic foam. Open cell viscoelastic foams may provide increased breathability, which may facilitate heat transfer. In certain aspects, the viscoelastic foam may be a "gel foam." Gel foams are formed by infusing the foam layer with a gel, which may be, for example, a polyol gel or the like. The gel, such as, for example, PRESERVE VG® available from Hickory Springs Manufacturing Company of Hickory, N.C., facilitates heat transfer to reduce the heat retention tendencies of viscoelastic foams. The gel may be formed into beads and added to the foam.

Viscoelastic foam generally conforms to a shape based on pressure and heat, such as body weight (or mass) and body heat. The viscoelastic first foam layer 206 may have a density between about 1.5 to about 7.5 pounds/cubic foot. The term "about" in this instance means within a tolerance of ±15%. The viscoelastic first foam layer 206 may further have a hardness of about 9 to about 14 indentation load deflect (generally known as "ILD" in the industry). The first foam layer 206 has an uncompressed thickness of approximately 1.25 to 10 cm (approximately 0.5 to 4 inches). The mattress 200 shown in FIG. 2 provides a first foam layer 206 with a thickness $T_1$ of approximately 1 inch. In another exemplary embodiment, associated with FIG. 4 below, the first foam layer may be, for example, 0.75 inches.

The first foam layer 206 may include phase change materials ("PCM") 208 as are generally known in the art. PCMs change phase from solids to liquids at the latent heat of phase change for the material (for example, the latent heat of phase change for ice is 32° F. at 1 atmosphere). Certain PCMs, such as paraffin waxes, change phase at a temperature that tends to maintain objects close to the body at a comfortable temperature. PCMs are further described in, for example, U.S. Pat. Nos. 5,499,460 and 5,637,389, both of which are incorporated herein by reference as if set out in full. The first foam layer 206 may further include antimicrobial materials 210. Antimicrobial materials 210, such as, for example, silver fibers, nanoparticles, or the like, enhance the ability of the first foam layer 206 to resist bacterial growth and the like.

As mentioned above, viscoelastic foams have a tendency to retain heat. The heat allows the viscoelastic foam to flow and form to a body contour but also may become uncomfortable after prolonged exposure to body heat. A second foam layer 212 may be provided with an open cell structure, sometimes referred to as reticulated foams. Generally, reticulated foams for the present purposes include foams where the air flow volume through the foam is greater than approximately 5 standard cubic feet/minute. The open cell structure provides for a high flow of gas through the foam enhancing the foams breathability. Generally, the second foam layer 212 has an uncompressed thickness $T_2$ of approximately 1.25 to 10 cm. The uncompressed thickness of second foam layer 212 may be of approximately the same thickness as the first foam layer 206. In some embodiments, the second foam layer 212 may be thinner than first foam layer 206. Alternatively, the second foam layer 212 may generally be thicker, such as 2× or 3× thicker, than the first foam layer 206. The open cell second foam layer 212 provides a heat sink for the first foam layer 206. The second foam layer 212 may have a density of about 1.5 to 3 pounds/cubic foot and an ILD of about 10 to 60.

As shown, the first foam layer 206 is placed directly on and aligned with the second foam layer 212. However, intermediate fabrics or foams may be placed between the first and second foam layers 206, 212. In certain instances, for example, a waterproof/breathable fabric 213 may be placed between the layers to allow the flow of gases but inhibit the flow of liquids. Such waterproof/breathable fabrics include GORE-TEX® fabrics such as are available from W.L. Gore & Associates.

The first and second foam layers 206, 212 are supported by a third foam layer 214. Generally, the third foam layer 214 is a conventional polyurethane foam. For the present purposes, the conventional polyurethane foam allows air flow through the foam at approximately 0 to 5 standard cubic feet/minute. For clarity, in the present application, reticulated foam means a non-viscoelastic, open foam cellular structure with air flow greater than about 5 SCF/M and open cell foam means a non-viscoelastic, open or closed, foam cellular structure with air flow less than about 5 SCF/M. The third foam layer 214 is generally the thickest layer and fills out the bulk of the mattress. The uncompressed thickness $T_3$ may range from up to about 12 cm to about 28 cm (which is about 5 inches to about 11 inches) and depends somewhat on the thickness of the first and second foam layers 206, 212 and whether the mattress is a twin, double, queen, king, or the like. In one exemplary embodiment, the third foam layer 214 was about 6 inches thick.

Generally, the mattress 200 may be boarded by foam sidewalls 216. The foam sidewalls generally have a width W of about 5 cm to 10 cm (or 2 to 4 inches). The constructed mattress 200 provides foam sidewalls 216 of a width of about 7.5 cm (or 3 inches). Generally, the foam sidewalls 216 in this exemplary embodiment are reticulated polyurethane foam, as the foam sidewalls 216 are not required to provide a significant amount of body support. The foam sidewalls 216 being constructed as reticulated foam facilitate the breathability of the mattress 200 and act generally as a heat sink.

Figure 3:
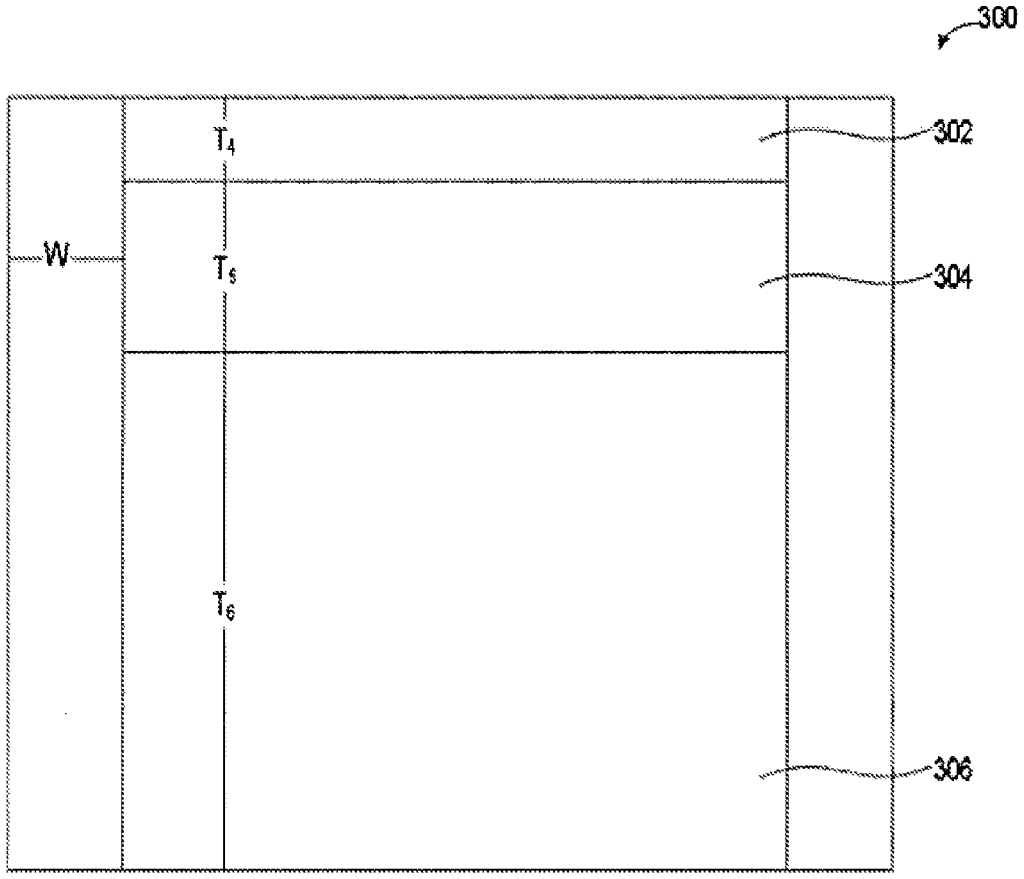
FIG. 3 depicts a cross sectional view of a mattress constructed in accordance with an aspect of the present technology.

With reference now to FIG. 3, a foam mattress 300 is provided. The foam mattress 300 is similar to the foam mattress 200 and comprises a first foam layer 302, a second foam layer 304, and a third foam layer 306. The first foam layer 302 comprises a viscoelastic foam layer similar to first foam layer 206. The first foam layer 302 has a thickness $T_4$ that is approximately 1 inch thick (or about 2.5 cm). In this exemplary embodiment, the second foam layer 304 of the foam mattress 300 comprises an open cell foam. The second foam layer 304 has a thickness $T_5$ that is approximately 2× the thickness of the first foam layer 302, or approximately 2 inches thick (or about 5 cm). Finally, the third foam layer 306, which is a conventional polyurethane foam, has a thickness $T_6$ that is approximately 7 inches thick (or about 17-18 cm). The mattress 300 is similarly encompassed by a foam sidewall 308. The sidewall 308 has a width that is approximately 3 inches.

Figure 4:
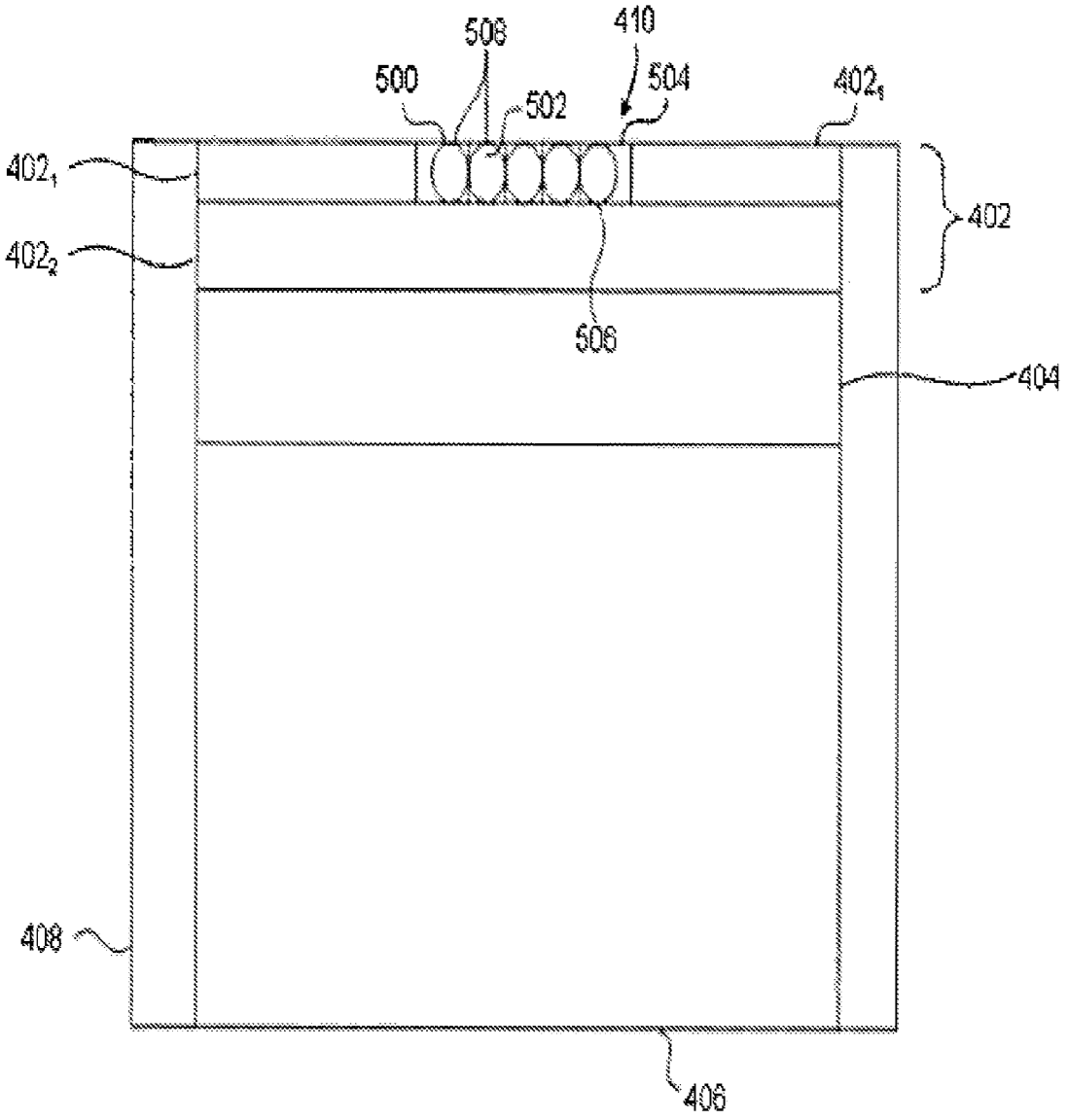
FIG. 4 depicts a cross sectional view of a mattress constructed in accordance with an aspect of the present technology.

With reference now to FIG. 4, a mattress 400 consistent with the technology of the present application is provided. The mattress 400 comprises a first foam portion 402, a second foam layer 404, and a third foam layer 406, all of which are surrounded by a foam sidewall 408. As shown in the cross-sectional view of FIG. 4, the first foam portion 402 is provided with a space 410, which may be a cavity, recess, or depression. The space 410 is approximately centered on mattress 400. As can be appreciated, the first foam portion 402 may be formed with the cavity 410 as a single slab of foam. However, it is more cost effective to provide the first foam portion 402 in two layers of foam $\mathbf{402}_1$ and $\mathbf{402}_2$. The first top foam layer $\mathbf{402}_1$ comprises a plurality of slabs or panels of foam placed on second top foam layer $\mathbf{402}_2$ where the second top foam layer $\mathbf{402}_2$ comprises a single slab of foam. A layer 500 comprising pocketed spring coils 502 is provided in the cavity 410.

Figure 5:
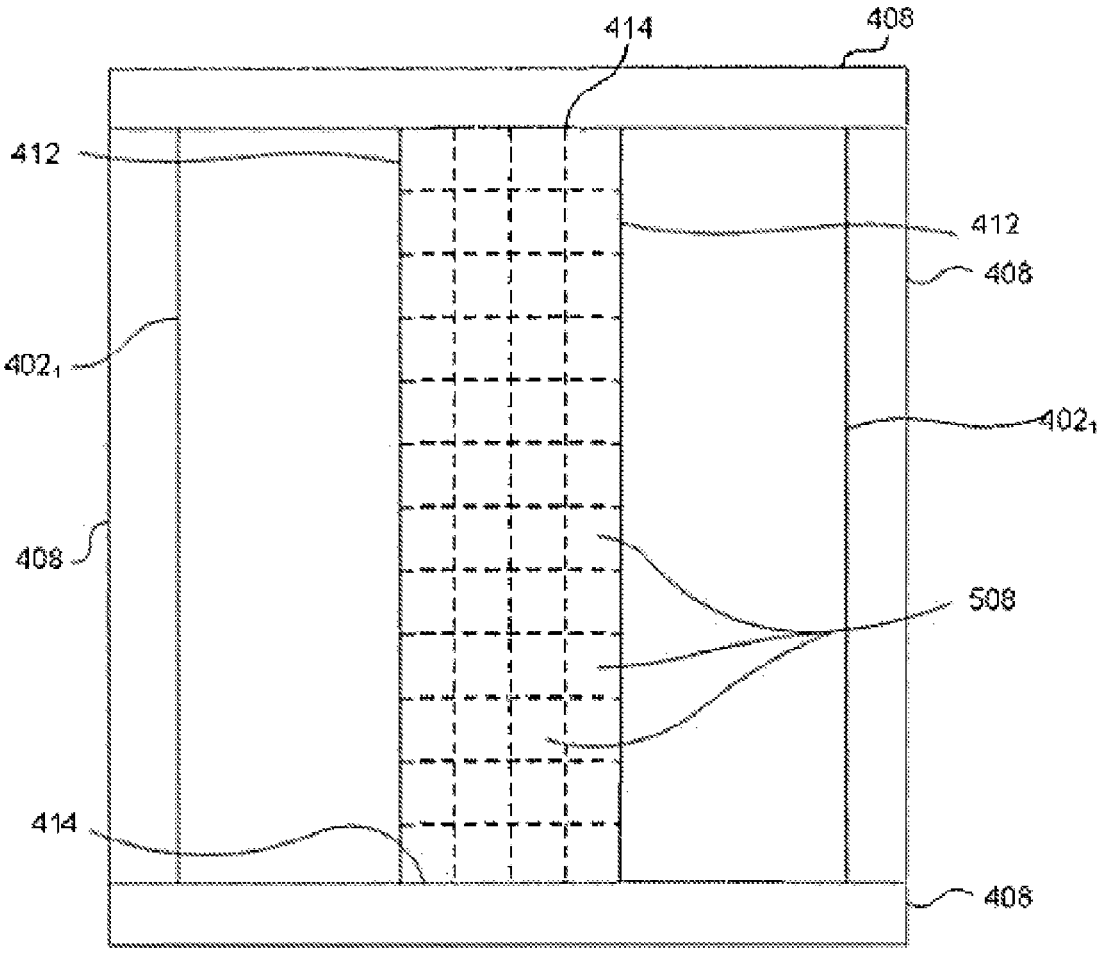
FIG. 5 depicts a top elevation view of the mattress of FIG. 4.

As shown in FIG. 5, which is a plan view of the mattress 400, the first top foam layers $\mathbf{402}_1$ are placed spaced apart by the space 410 such that the cavity is bounded by an inner surface 412 of the first foam layers and an inner surface 414 of the foam sidewalls 408. Alternatively, a plurality of first top foam layers $\mathbf{402}_1$ may be placed such that the space 410 is bounded by inner surfaces 412 of the first top foam layers $\mathbf{402}_1$ on all sides.

With reference back to FIG. 4, the layer 500 includes a plurality of individually pocketed spring coils 502. The layer 500 includes a top fabric 504 and a bottom fabric 506 that are adhered together in a pattern that produces pockets 508 (see FIG. 5). The fabrics 504, 506 can generally be any type of textile, woven or non-woven. The adhering of the top and bottom fabrics 504, 506 may be through stitching, welding, gluing, or the like. The pockets 508 or voids hold spring coils 502. The individual springs provide increased support and comfort over, for example, innerspring coil core or the like.

Construction of the layer 500 typically results in a layer 500 having a thickness of approximately 1.3 cm to 6.4 cm (or about 0.5 inches to 2.5 inches). The exemplary construction of mattress 400 resulted in the layer 500 having a thickness of approximately 2 cm (or 0.75 inches). Thus, the depth of the space 410, or the depth of the recess, needs to be approximately 2 cm in this exemplary embodiment. If the first foam portion 402 is formed by a first and second top foam layer $\mathbf{402}_1$, $\mathbf{402}_2$, then the first top form layer $\mathbf{402}_1$ is sized with a thickness equal to the thickness of the layer 500. The second top foam layer $\mathbf{402}_2$ is sufficiently thick to provide the effective comfort of the viscoelastic foam about where the layer 500 resides. In the exemplary embodiment constructed, the thickness of the second top foam layer $\mathbf{402}_2$ is approximately 3 to 3.5 cm (or about 1.25 inches in the above exemplary embodiment). Thus, the thickness of the first foam portion 402 is approximately 5 to 6 cm (which is about 2 inches).

Although the technology has been described in language that is specific to certain structures and materials, it is to be understood that the invention defined in the appended claims is not necessarily limited to the specific structures and materials described. Rather, the specific aspects are described as forms of implementing the claimed invention. Because many embodiments of the invention can be practiced without departing from the spirit and scope of the invention, the invention resides in the claims hereinafter appended. Unless otherwise indicated, all numbers or expressions, such as those expressing dimensions, physical characteristics, etc., used in the specification (other than the claims) are understood as modified in all instances by the term "approximately." At the very least, and not as an attempt to limit the application of the doctrine of equivalents to the claims, each numerical parameter recited in the specification or claims that is modified by the term "approximately" should at least be construed in light of the number of recited significant digits by applying ordinary rounding techniques. Moreover, all ranges disclosed herein are to be understood to encompass and provide support for claims that recite any and all subranges or any and all individual values subsumed therein. For example, a stated range of 1 to 10 should be considered to include and provide support for claims that recite any and all subranges or individual values that are between and/or inclusive of the minimum value of 1 and the maximum value of 10, that is, all subranges beginning with a minimum value of 1 or more and ending with a maximum value of 10 or less (e.g., 5.5 to 10, 2.34 to 3.56, and so forth) or any values from 1 to 10 (e.g., 3, 5.8, 9.9994, and so forth).

What is claimed is:

1. A mattress comprising, a first foam portion having a first thickness, the first foam portion comprising a viscoelastic foam, the viscoelastic foam having a first density and a first hardness, the first foam portion having a top surface comprising a recess;

a second foam portion having a second thickness, the second foam portion comprising a reticulated cell foam structure, the second foam portion having a second density less than the first density and a second hardness less than the first hardness, wherein the second foam portion has a higher percentage of open cells than the first foam portion;

a third foam portion having a third thickness greater than both the first and second thicknesses, the third foam portion comprising an open cell foam structure, wherein the third foam portion has a third density and a third hardness wherein the third density and the third hardness are greater than the second density and the second hardness and wherein the third foam portion has a lower percentage of open cells than the second foam portion;

a foam sidewall extending from a top of the first foam portion to a bottom of the third foam portion; and a layer sized to cooperatively engage with the recess wherein the top surface of the foam portion and the layer form a body facing surface of the mattress, the layer comprising a first fabric coupled to a second fabric forming a plurality of individual pockets wherein each pocket of the plurality of individual pockets contains a single spring.

2. The mattress of claim 1 wherein the foam sidewall comprises reticulated foam.

3. The mattress of claim 2 wherein the first foam portion comprises reticulated viscoelastic foam.

4. The mattress of claim 1 wherein the viscoelastic foam is infused with a polyurethane gel.

5. The mattress of claim 1 wherein the viscoelastic foam comprises a plurality of polyurethane gel beads.

6. The mattress of claim 1 wherein the viscoelastic foam is loaded with phase change materials.

7. The mattress of claim 1 wherein the viscoelastic foam is loaded with at least one antimicrobial.

8. The mattress of claim 1 wherein the first foam portion comprises a first top foam layer and a second top foam layer wherein each of the first and second top foam layers comprise viscoelastic foams.

9. The mattress of claim 8 wherein the first top foam layer and the second top foam layer comprise viscoelastic foams with an identical chemical composition.

10. The mattress of claim 8 wherein the first top foam layer comprises a plurality of first top foam layers and wherein the recess is formed in part by a gap between inner surfaces of the plurality of first top foam layers.

11. The mattress of claim 1 wherein each single spring has an uncompressed thickness of less than 2 cm.

12. A mattress comprising, a first foam portion comprising a plurality of first top foam layers residing on a single second top foam layer, each of the plurality of first top foam layers comprising an inner surface wherein a recess is defined in the first foam portion by at least one of the inner surfaces and by a top surface of the single second top foam layer, wherein the plurality of first top foam layers have a first thickness, the recess has a first depth, and the single second top foam layer has a second thickness approximately equal to the first thickness, the plurality of first top foam layers and the second top foam layer comprise identical chemical compositions wherein the plurality of first top foam layers are coupled to the second top foam layer without any intervening members;

a second foam layer attached to a first bottom of the first foam portion, the second foam portion comprising a reticulated foam, the second foam layer having a third thickness wherein the third thickness is greater than the first thickness and the second thickness;

a third foam portion having a fourth thickness greater than each of the first, second, and third thicknesses, the third foam portion comprising a generally closed or open cell foam structure; and a layer comprising a top textile material coupled to a bottom textile material forming at least one pocket and a spring in the at least one pocket, wherein the spring has an uncompressed thickness between 1 to 6 cms.

13. The mattress of claim 12 wherein the spring comprises a coiled spring.

14. The mattress of claim 12 wherein the spring comprises an innerspring core.

15. The mattress of claim 12 wherein the first top foam layer and the second top foam layer comprise a viscoelastic foam.

16. The mattress of claim 15 wherein the viscoelastic foam is a reticulated viscoelastic foam.

* * * * *